United States Patent [19]

Brink et al.

[11] Patent Number: 4,715,628

[45] Date of Patent: Dec. 29, 1987

[54] CHILD RESISTANT CABINET LOCK COMBINATION FINGER LOCK

[76] Inventors: Satya S. Brink, R.R. 1, Box 836, Chelsea, Quebec, Canada, J0X 1N0; John H. Baines; Suzanne C. M. Poulin, both of 16 Beckwith Rd., Ottawa, Ontario, Canada, K1S 0K7

[21] Appl. No.: 800,549

[22] Filed: Nov. 21, 1985

[51] Int. Cl.[4] ..... E05C 19/06

[52] U.S. Cl. ..... 292/19; 292/87

[58] Field of Search ..... 292/19, 22, 89, 87, 292/88, 85, 80, 209, DIG. 65

[56] References Cited

U.S. PATENT DOCUMENTS

| | | | |
|---|---|---|---|
| 3,397,001 | 8/1968 | Friedman | 292/87 |
| 4,191,411 | 3/1980 | Rodgers | 292/87 |
| 4,198,084 | 4/1980 | Trotta | 292/209 |
| 4,416,477 | 11/1983 | Bialobrzeski et al. | 292/19 |
| 4,505,526 | 3/1985 | Leck | 292/80 X |
| 4,542,924 | 9/1985 | Brown et al. | 292/87 |

*Primary Examiner*—Carl D. Friedman

*Assistant Examiner*—Creighton Smith

[57] ABSTRACT

The invention relates to a lock for kitchen and bathroom doors and drawers and the like. The lock is secured to the door or drawer and restricts access of children to such cabinets and drawers. The invention uses the difference between the middle and third fingers on an adult's hand combined with a specified stiffness in the locks operating parts to restrict children from operating the lock. As well the lock is a combination finger lock where there are dummy locking devices. The lock comprises a pair of locking protrusions which interlock with catches on the cabinet frame. A set of blocking protrusion joined by a bar and or pad. The blocking protrusions interlock with the locking protrusions preventing their movement downwards until the blocking protrusions are moved downwards first. A set of dummy protrusions, somewhat similar in shape and design to the locking protrusions, interlock with the catches on the cabinet frame when they are inadvertently pressed down.

11 Claims, 4 Drawing Figures

CHILD RESISTANT CABINET LOCK COMBINATION FINGER LOCK

BACKGROUND OF THE INVENTION

The present invention relates to a lock to restrict a child's entry to doors, drawers or the like.

Before the development of child restraint bottle caps, various drugs and other bottled toxins were the casue of many child poisonings. At the present household poisons in kitchen and bathroom cabinets are a major source of child poisonings. As well as household poisons, china, crystal, liquor, guns and sharp objects must be kept out of the reach of young children. To secure cabinets and drawers there are several types of child proof, add-on locks on the market for example as described and illustrated in U.S. Pat. No. 3,97,001. Locks of this type are adequate in preventing children up to the age of two from opening cabinet doors. However such locks are inadequate for older children which learn to imitate the actions required to open such locks. Other child resistant locks for example as described and illustrated in U.S. Pat. Nos. 1,042,947 and 2,742,314 require too much modification to existing cabinetry to make them popular.

It is an object of the present invention to provide a simple to construct, easily operable lock to restrict entry of children through doors and drawers.

SUMMARY OF THE INVENTION

According to the present invention there is provided a lock for a door, drawer or the like, with a pair of locking protrusions which interlock with a pair of catches attached to the cabinet frame when the door is slightly open. A second pair of dummy protrusions interlock with these catches when they are pressed down. A third set of blocking protrusions are attached to and interconnected by a bar and or pad. The bar is set between the first locking protrusions. The third set of protrusions interlocks with the first set preventing them from moving downwards until the third set is moved downwards first.

The lock is opened by using the three large fingers on the hand. The middle finger, the longer one, presses the pad which attaches to and interconnects with the third set of blocking protrusions unlocking them from the first set of locking protrusions. The two fingers on either side of the middle finger press down on the pair of locking protrusions moving them downwards after the blocking set has been disengaged, and thus releasing them from the catches on the cabinet door; at this time the door can be opened.

The interlock between the locking and blocking protrusions is a distance equal to the difference between the length of the middle finger and the other two on a small woman. The locks are stiff enough so that children could not press the protrusions downwards with bent fingers, or with a piano-type movement. These dimensional characteristics of the lock prevents children from imitating elders.

That part of the protrusion which interlocks with the catches on the cabinet frame, is offset to one side so the long finger nails that some women have will not interfere with the operation of the lock.

The third set of dummy protrusions interlock with the catches when pressed inadvertenty by children trying to open the lock. These protrusions also have an upturned, hooked end which will prevent objects being thrust into it so as to pry it open. This set of protrusions are more easily pressed downwards then the others, so as to entice children to operate them.

BRIEF DESCRIPTION OF DRAWINGS

Other objects and advantages of the invention will become apparent upon reading the following detailed description and upon referring to the drawbacks in which.

While the invention will be described in conjunction with this example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

Figure 1:
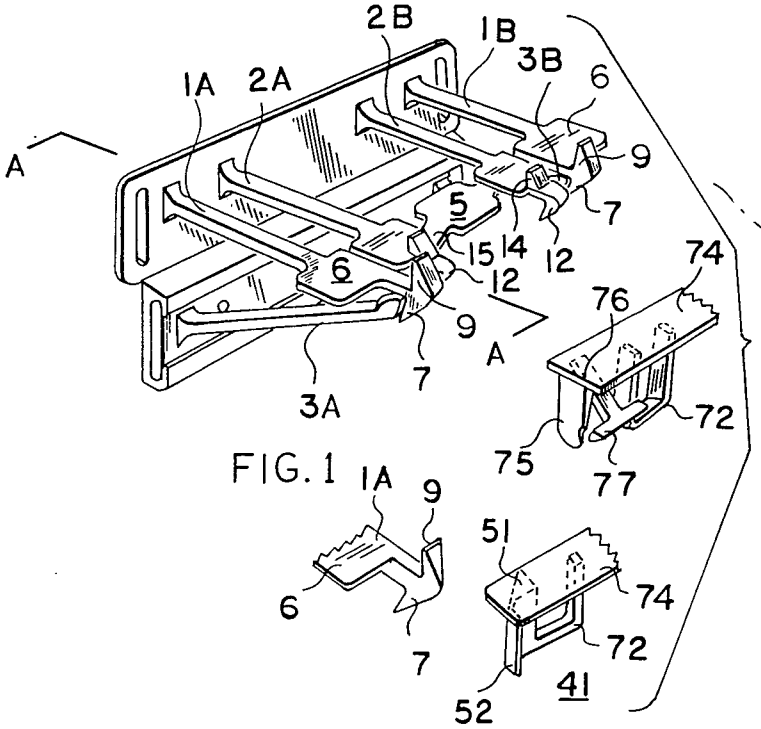
FIG. 1 is a perspective view of an example embodiment of the lock according to the present invention attached to the door.
Figure 4:
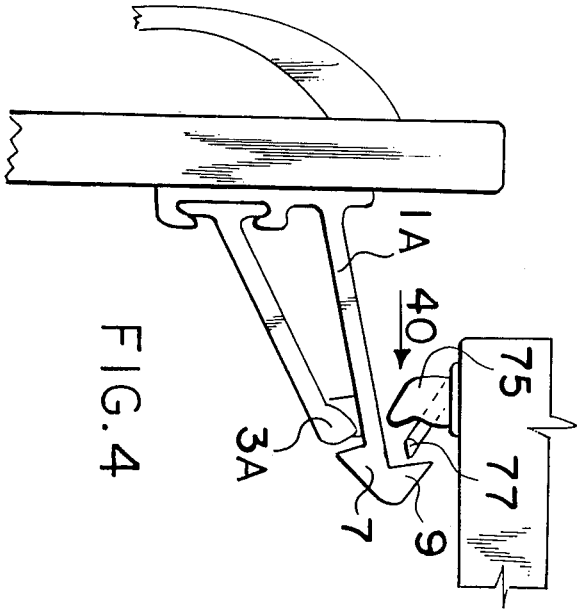
FIG. 4 is a side view of the lock of FIG. 1.

In FIG. 1, 1*a* and 1*b* are the locking protrusions. The locking ends 9 interlock with bar-catch 77 which is part of catch mechanism 40 which inturn is attatched to the frame of the cabinet 32, FIG. 4.

Pads 6, which are attached to the locking protrusions 1*a* and 1*b* and locking end 9 which is offset to one side of pad 6, allows one to place ones fingernail over the edge of the pad so as not to have difficulty pressing on the locking protrusions 1A and 1B.

Blocking protrusions 3*a* and 3*b* interlock with the lower hooked end 7 of the locking protrusion 1*a* and 1*b*.

Pad 5 is joined to the blocking protrusions 3*a* and 3*b* by bars 15.

Figure 3:
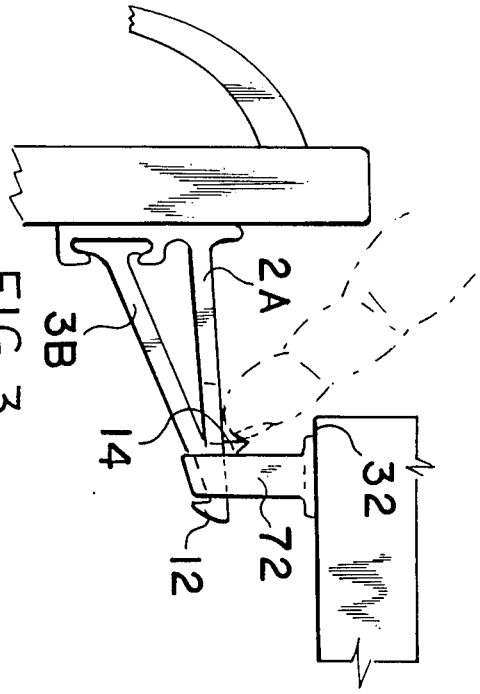
FIG. 3 is a side section view of the lock of FIG. 1 showing a child operating the lock, and the interlocking of the dummy protrusion and the catch.

Dummy protrusions 2*a* and 2*b* have lower hooked ends 12 which interlock with catches 72. FIG. 3, on the frame of the cabinet 32. Upturned ends 14, which are part of the dummy protrusion 2*a* and 2*b* prevent children from jambing objects into the lock so as to pry it open.

Figure 2:
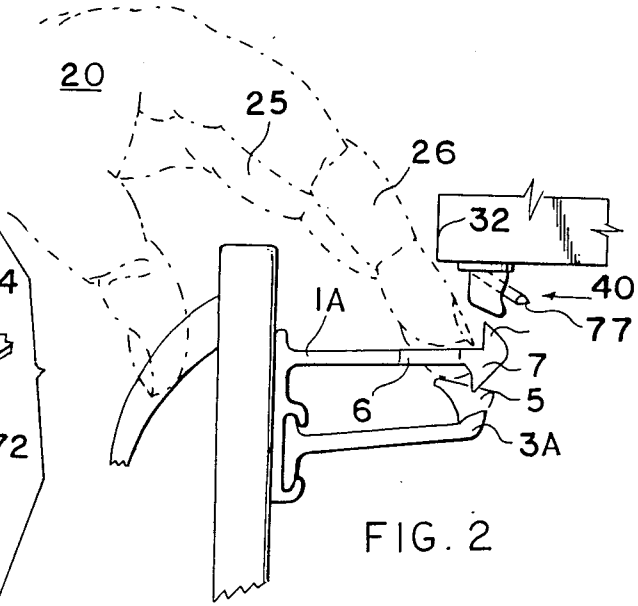
FIG. 2 is a side view of the lock of FIG. 1 being opened by an adult hand, it also shows a catch attached to the top of the cabinet frame.

FIG. 2 shows an adult hand 20 opening the lock. Middle finger 25 pushes pad 5 which is joined to blocking protrusion 3*a*. Finger 26 pushes on pad 6 which is connected to locking protrusion 1*a*. Because finger 25 is longer than finger 26 pad 5 moves downwards first thus unlocking the blocking protrusion 3*a* from the hooked end 7. When finger 26 has pushed locking protrusion 1*a* lower that bar-catch 77 the door can be opened.

In FIG. 3 a child's finger 33 pushes downwards on dummy protrusion 2*a*. The lower hooked end 12 of this protrusion interconnects with catch 72 on cabinet frame 32. This prevents the door form opening.

FIG. 1 shows catch 77 attatched to an arm 76 which inturn is attatched to a base 74. The base is attatched to the cabinet frame FIG. 4. The flexible arm 76 allows for hooked end 9 of locking protrusion to pass by catch 77 when the door is closed.

What we claim as our invention:

1. A lock for a door or drawer or the like, movable with respect to a frame, to restrict children from gaining entry, the lock comprising:

(a) a base to be attached to the door or drawer, (b) a pair of locking protrusions, secured to the base, with ends normally to interlock with catches to be attached to the cabinet frame, the locking protrusions positioned to be pushed downwards with the index and 3rd finger of an adult so as to clear the catches, (c) blocking protrusions secured to the base, an interconnecting-bar means joining the blocking protrusions, movement of the interconnecting-bar means causing corresponding movement of the blocking protrusions, the interconnecting-bar means positioned to be pushed downwards with the middle finger of an adult, the blocking protrusions to engage with the locking protrusions and prevent their depression and thereby prevent opening of the door or drawer when: (i) the interconnecting-bar means is in undepressed position or (ii) when the interconnecting-bar means and locking protrusions are depressed before the blocking protrusions so that the locking protrusions remain interlocked with the catches on the cabinet frame, and when the interconnecting-bar means and blocking protrusions are depressed before the locking protrusions, the blocking protrusions to disengage from the locking protrusions to allow the locking protrusions to move away from the catches on the cabinet frame upon being pushed downwards with the index and 3rd finger.

2. A lock according to claim 1, further provided with dummy protrusions secured to the base and positioned to interlock with the catches on the cabinet frame when they are acted upon by a child.

3. A lock according to claim 2 wherein the dummy protrusions have upturned ends.

4. A lock according to claim 2 wherein the dummy protrusions are easier to press down than the other protrusions.

5. A lock according to claim 1 wherein the stiffness of the locking and blocking protrusions does not allow for a child to press them down with bent fingers or with a piano-type finger motion.

6. A lock according to claim 1 wherein pads are attached to the locking protrusions so as to allow for the protrusions to be pressed down easily.

7. A lock according to claim 6 wherein the pads have instructions printed on them as to which ones to push.

8. A lock as in claim 7 wherein the locking ends of the locking protrusions are offset to on side so as to allow for finger nails to hang over the ends of the pads.

9. A lock as in claim 1, wherein the catch on the cabinet is attatched to a flexible arm and where there is a stop behind the catch so that the catch can only move inwards.

10. A lock according to claim 2 wherein the locking, blocking and dummy protrusions project outwardly with respect to the base.

11. A lock according to claim 1 wherein the locking and blocking protrusions are positioned so that they will disengage when the blocking protrusions are pushed a distance equal to the difference beteen the middle and 3rd finger of a small woman's hand.

* * * * *